United States Patent [19]

Iwaya

[11] Patent Number: 4,876,570

[45] Date of Patent: Oct. 24, 1989

[54] IMAGE RECORDING APPARATUS

[75] Inventor: Toshio Iwaya, Shiki, Japan

[73] Assignee: Canon Kabushiki Kaisha, Tokyo, Japan

[21] Appl. No.: 244,157

[22] Filed: Sep. 14, 1988

[30] Foreign Application Priority Data

Sep. 21, 1987 [JP] Japan ..... 62-236741
Dec. 11, 1987 [JP] Japan ..... 62-311841

[51] Int. Cl.[4] ..... G03G 15/00

[52] U.S. Cl. ..... 355/204; 355/203; 355/218; 355/206

[58] Field of Search ..... 355/203, 204, 206, 218

[56] References Cited

U.S. PATENT DOCUMENTS 4,390,266 6/1983 Uchida ..... 355/203 X
4,462,676 7/1984 Shimura et al. ..... 355/203
4,627,721 12/1986 Nguyen et al. ..... 355/203 X
4,733,271 3/1988 Arai ..... 355/218 X
4,745,441 5/1988 Maruta et al. ..... 355/218
4,761,673 8/1988 Watanabe et al. ..... 355/218
4,763,165 8/1988 Watanabe ..... 355/218 X

*Primary Examiner*—A. C. Prescott
*Attorney, Agent, or Firm*—Fitzpatrick, Cella, Harper & Scinto

[57] ABSTRACT

An image recording apparatus comprises first signal output means for producing a signal indicating a recorded area of a recording medium, second signal output means for producing a signal indicating an image area to which an original document is to be copied, and control means for determining whether the recorded area and the copy area overlap based on the signals produced by the first and second signal output means, and if they overlap, issuing an alarm or inhibiting copying of the original document to the recording medium.

22 Claims, 13 Drawing Sheets

IMAGE RECORDING APPARATUS

BACKGROUND OF THE INVENTION

1. Field of the Invention

The present invention relates to an image recording apparatus such as an electrophotographic copying machine or electrostatic recording machine for recording an image or a recording medium.

2. Related Background Art

In the conventional image recording apparatus of this type, an original image is recorded over an entire area of a recording medium.

As a result, where a recording medium having information printed on a portion thereof is to be used, the image is recorded in the information recorded area unless an image copy area is specified to avoid the information recorded area, and the information in the overlapped information area is hard to recognized If images are continuously recorded without knowing if the recorded image is overlapped, a large number of inaccessible records are prepared.

For example, in a conventional transfer type electrophotographic copying machine which uses a micro-film an entire area of an image on the micro-film is copied on a recording medium such as a sheet.

FIG. 1(A) shows an image on a micro-film and FIG. 1(B) shows an image copied onto a transfer sheet. In FIG. 1(A), a positive (or negative) image in a frame f has been recorded on the micro-film F. Where a periphery of the frame f is positive, it is black (where it is negative, light transmits through the periphery.) In copying the image on the micro-film F to the transfer sheet, an entire area of a copy area G of the micro-film is copied to the transfer sheet P as shown in FIG. 1(B).

However, in the above image recording apparatus, where partially printed transfer sheets are stacked in a paper cassette, and if a to-be-copied image area of the micro-film preset by copy area setting means and the printed area on the recording medium overlap, a portion of the image of the micro-film corresponding to the overlapped area is not copied to the recording medium, or the image in the overlapped area cannot be recognized. The operator may not be aware of such overlapped copying.

SUMMARY OF THE INVENTION

It is an object of the present invention to provide an image recording apparatus which can prevent a to-be-copied image area of an original image such as micro-film from overlapping with a recorded area on a recording media.

It is another object of the present invention to inform to an operator of overlapped copying to prevent misoperation and unacceptable reproduction.

It is another object of the present invention to provide an image recording apparatus capable of recording an image of an original document on only unprinted area of a recording medium having predetermined information partially printed thereon.

The image recording apparatus of the present invention comprises first signal output means for producing a signal indicating a recorded area of a recording medium, second signal output means for producing a signal indicating an image area to which an original document is to be copied, and control means for determining whether the recorded area and the copy area overlap based on the signals produced by the first and second signal output means, and if they overlap, issuing an alarm or inhibiting copying of the original document to the recording medium.

DESCRIPTION OF THE PREFERRED EMBODIMENTS

Figure 1A:
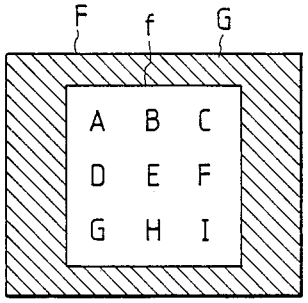
FIG. 1A shows a micro-film image.
Figure 1B:
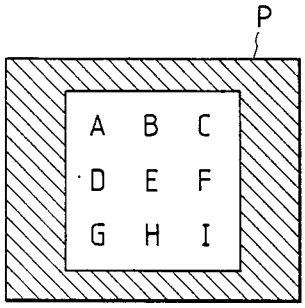
FIG. 1B shows an image copied on a transfer sheet.
Figure 2:
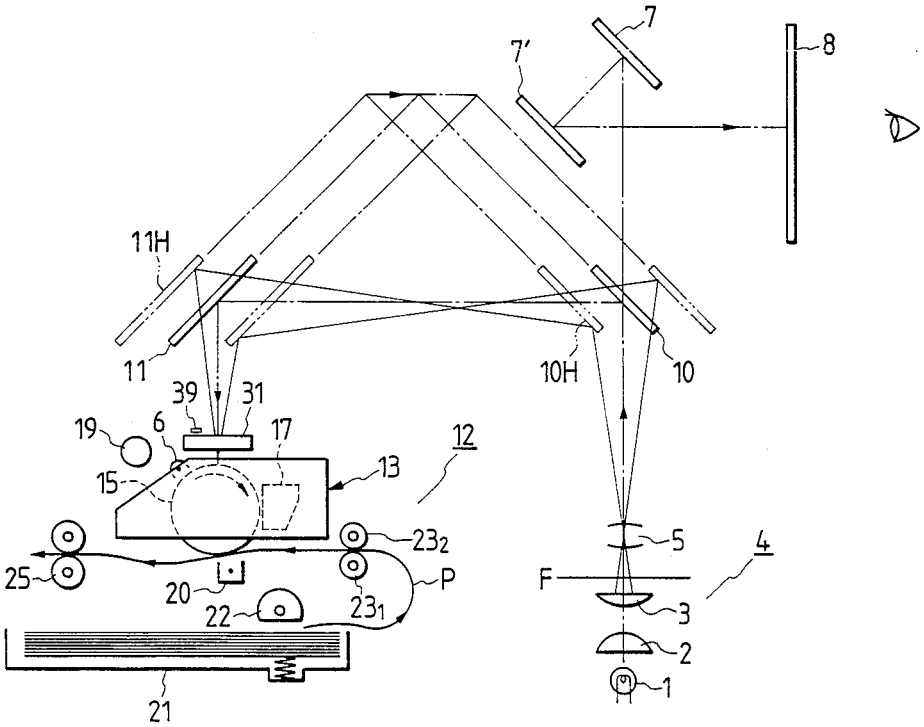
FIG. 2 shows a configuration of one embodiment of an image recording apparatus of the present invention.
Figure 3:
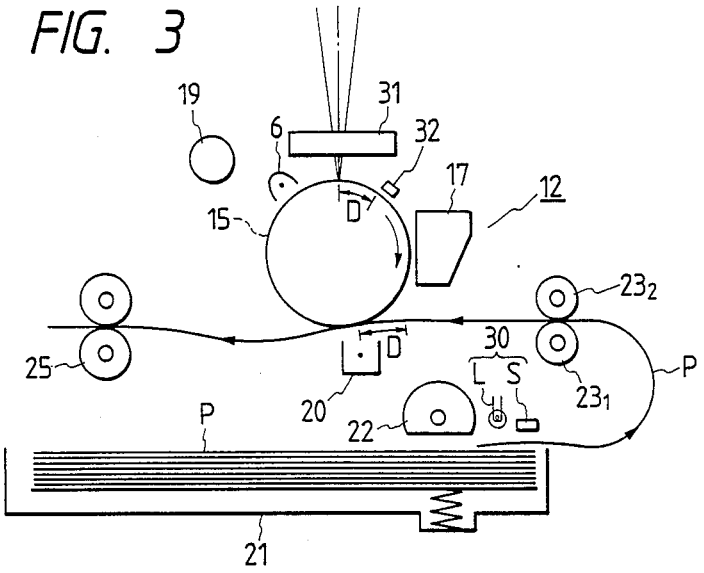
FIG. 3 shows a partial enlarged view thereof.

FIG. 2 shows a microfilm reader/printer as the image recording apparatus of the present invention, and FIG. 3 shows an enlarged view of a copying unit.

In FIGS. 2 and 3, an image of a film F is projected to a screen 8 through a projection unit including an illumination light source 1, a condenser lens 2, a field lens 3 and a projection lens 5, and mirrors 7 and 7'.

When the image of the film F is to be copied to a transfer sheet P as a recording medium, mirrors 10 and 11 which are at home positions 10H and 11H are moved into a light path of the projection unit 4 so that image light is sequentially directed to a copying unit 12.

The copying unit 12 is provided with a process unit for forming an image by electrophotography. Numeral 13 denotes a cartridge in which at least one of elements of the process unit, for example, a photoconductor drum 15 a developing unit 17, a primary charger 6 and a cleaner (not shown) is mounted. Numeral 19 denotes a predischarge exposure lamp, numeral 20 denotes a transfer charger, numeral 21 denotes a cassette which contains transfer sheets P, numeral 22 denotes a synchronous paper feed roller, numerals $23_1$ and $23_2$ denote paper feed rollers and numeral 25 denotes a fixing unit.

The construction and function of the copying unit 12 have been known and the explanation thereof is omitted.

Numeral 30 denotes information recorded area detection means for detecting a recorded area A of the transfer sheet P on which predetermined information such as company name and address has been recorded. The unrecorded area of the transfer sheet P is referred to as unrecorded area B. The detection means may comprise a photo-sensor S having charge coupled devices (CCD) arranged at a high density and a transfer sheet illumination lamp L. It is fixed to facing movement path of the transfer sheet P which is fed from the cassette 21, or the photo-sensor S and the lamp L are moved to scan the transfer sheet P in the cassette to detect the area A of the transfer sheet P.

Numeral 31 denotes a liquid crystal shutter arranged in an exposure light path to the photoconductor drum 15, and numeral 32 denotes an eraser comprising a light emitting diode LED. The liquid crystal shutter 31 and the eraser 32 constitute image copy area control means for controlling an image copy area for the transfer sheet P.

Figure 5:
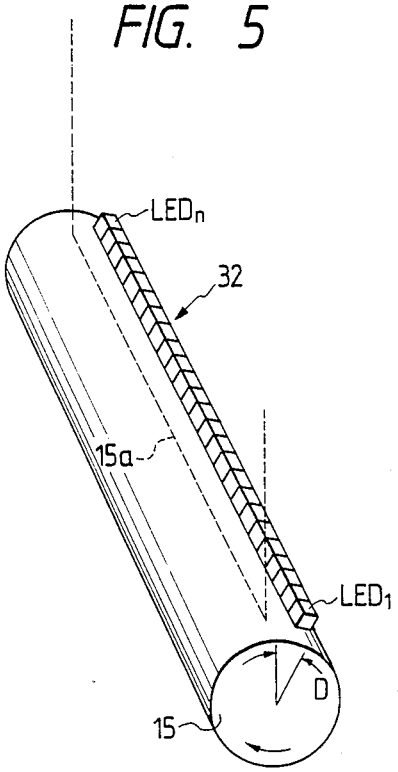
FIG. 5 shows an eraser.
Figure 4:
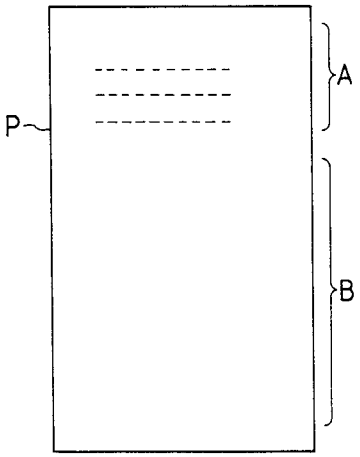
FIG. 4 shows a front view of a transfer sheet having information partially recorded thereon.

FIG. 5 illustrates the eraser 32. The eraser 32 is arranged in parallel to an axial line of photoconductor drum 15, and displaced in a rotational direction, from an exposure focusing line 15*a* on the photoconductor drum 15 by a distance D. Accordingly, the photo-sensor S is arranged at any position within the distance D from the position of transfer charge 20.

Figure 6:
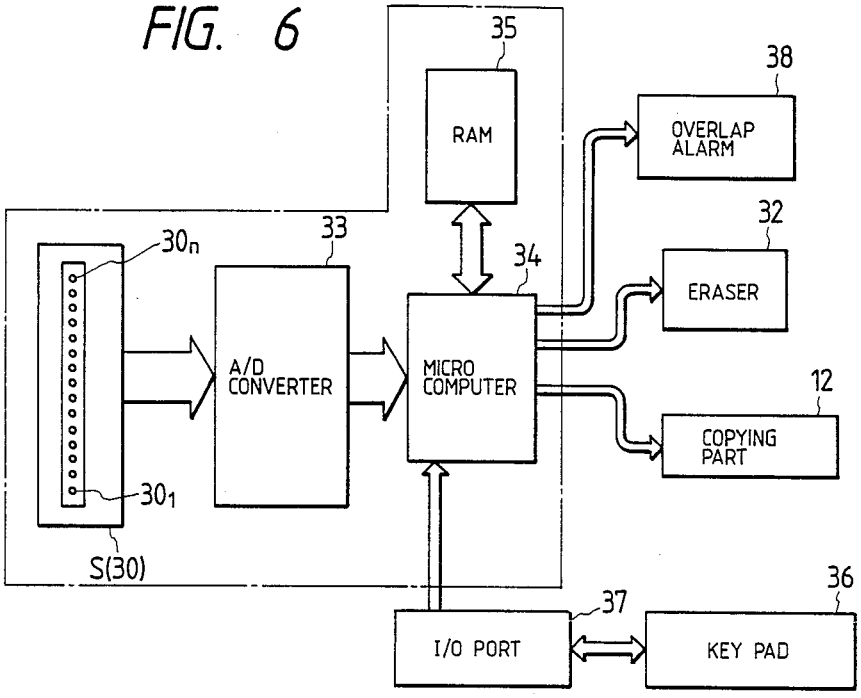
FIG. 6 shows a block diagram of a control unit.

FIG. 6 shows a block diagram of the control unit. In FIG. 6, numerals $30_1$–$30_n$ denote photo-detectors of the photo-sensor S, numeral 33 denotes an A/D converter, numeral 34 denotes a microcomputer as control means, numeral 35 denotes a RAM as storage means, numeral 36 denotes a key pad and a numeral 37 denotes an I/O port. The key pad 36 and the I/O port 37 constitute image copy area specifying means for specifying an image copy area for the recording medium. Numeral 38 denotes an overlap alarm.

Figure 7:
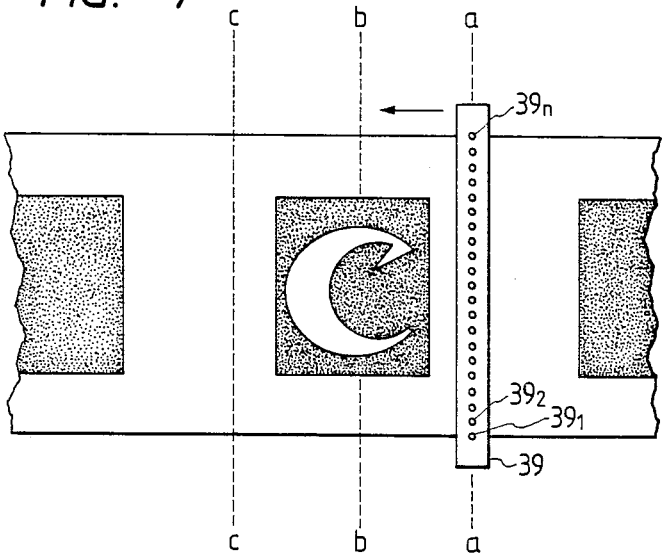
FIG. 7 illustrates reading of an image on a film.
Figure 8:
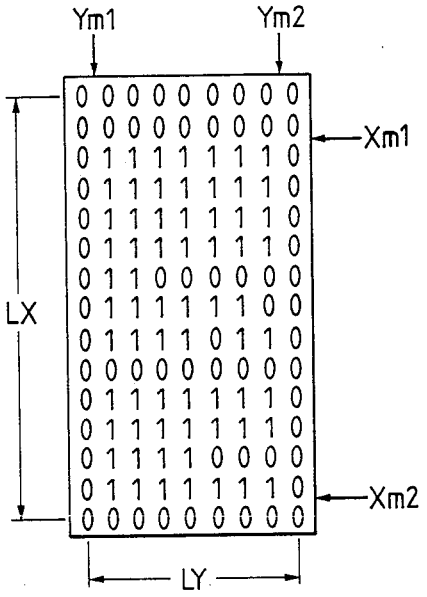
FIG. 8 shows a content of a RAM at the end of scan of the film image.

On the liquid crystal shutter 31, photodetectors $39_1$–$39_n$ of a photo-sensor 39, which is made of amorphous silicon, are arranged at a predetermined pitch as shown in FIG. 7. The photo-sensor 39 detects the image area on the film F. The image area of the film is divided in accordance with the pitch of the photo-detectors $39_1$–$39_n$, and data having a higher intensity than a slice level is coded as "0" and the data having a lower intensity is coded as "1". They are sequentially stored in a RAM 35 as shown in FIG. 8.

In order to specify the image copy area for the transfer sheet P, the key pad 36 is manipulated and the output from the key pad 36 is stored, through the I/O port 57 and the micro-computer 34, into the RAM 35 at the film image area as the specified image area information.

For example, in order to specify an X axis, keys "X" and "1" on the key pad 36 are sequentially depressed, and a position of "Xm1" is set in millimeters. Then, keys "X" and "2" are depressed and a position of "Xm2" is set.

On the other hand, in order to specify a Y axis, keys "Y" and "1" are depressed, and a position of "Ym1" is set in millimeters. Then, keys "Y" and "2" are depressed and a position of "Ym2" is set.

Figure 9:
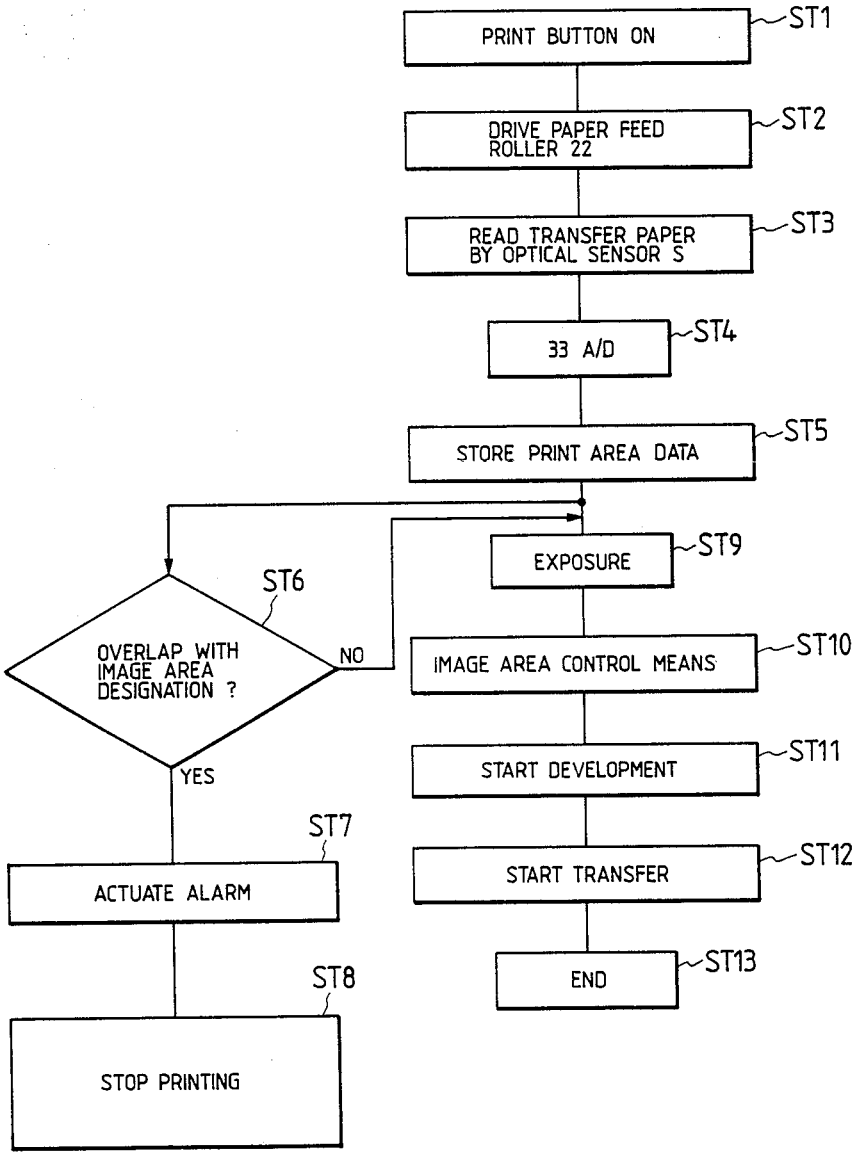
FIG. 9 shows a flow chart for explaining an image recording operation by the present apparatus.

The image record operation of the present embodiment is now explained with reference to a flow chart of FIG. 9. Prior to image exposure to the photoconductor drum 15, the transfer sheet P is fed (step ST2) from the cassette 21 by the paper feed roller 22 driven by a print button (step ST1), and the transfer sheet P is scanned by the photo-sensor S to detect light from the areas A and B (step ST3).

The intensity data detected by the photo-sensor S during the feed of the transfer sheet is digitized by the A/D converter 33 (step ST4) and it is read into the microcomputer 34, which binaries the data by a predetermined threshold (slice level) and stores it into the RAM 35.

The intensity distribution of the transfer sheet is divided by a predetermined time interval in the feed direction of the transfer sheet and by the pitch of the photo-detectors $30_1$–$30_n$ in the direction orthogonal to the feed direction. The data having a higher intensity level than the slice level is coded as "0", and the data having a lower intensity level is coded as "1". They are sequentially stored in the RAM 35.(step ST5) The content of the RAM 35 at the end of the scan of the transfer sheet P is shown in FIG. 10 in which the area A is shown by "1" and the area B is shown by "0", and $L_x$ and $L_y$ correspond to the lateral and longitudinal lengths of the transfer sheet P.

Figure 10:
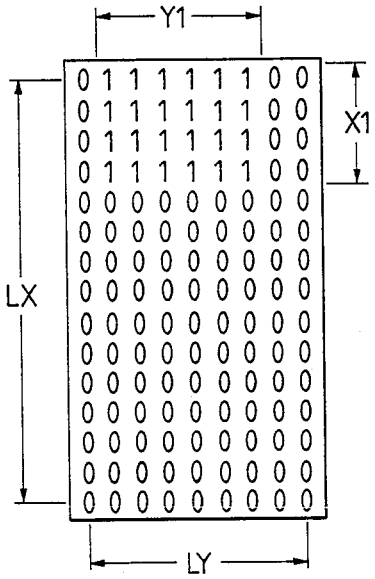
FIG. 10 shows a content of the RAM at the end of scan of the transfer sheet information.

The microcomputer 34 uses the contents of RAM 35 to calculate the lengths of $X_1$ and $Y_1$ shown in FIG. 10 to determine the area A, determines overlap between the image copy areas "Xm1"–"Xm2" and "Ym1"–"Ym2" (step ST6), and if the images overlap, activates the alarm 32 to alarm by flashing a lamp or generating sound (step ST7) and stops printing (step ST8) to prevent wasteful printing.

In brief, the image copy area is specified by the coordinates X and Y and the coordinate specifying key pad 36 as the image copy area specifying means, and the information is read by the microcomputer through the I/O port 37. In response to the information, the microcomputer 34 sends a signal to the image area specifying circuit which controls the LED 32 or transfer changer 20 condition to produce the specified image.

When the alarm 38 is issued, (step ST7) the operator manipulates a lens (not shown) in the image exposure unit to reduce the exposure image to the transfer sheet P in order to avoid the overlap of the image.

Then, the projection light of the image is scanned by the scan mirrors 10 and 11 to expose it onto the photoconductor drum 15 to form a latent image (step ST9).

Assuming that a positive transfer image is to be formed on the transfer sheet P from a positive image of the film F, the liquid crystal shutter 31 is rendered to a transmission mode when the light is exposed to the photoconductor drum 15 in order to form a latent image on the photoconductor drum 15. Then, the eraser 32 is controlled in accordance with the area A of the transfer sheet P detected previously such that the eraser 32 is activated only while the area of $X_1$ and $Y_1$ in FIG. 10 of the latent image faces the eraser 32 shown in FIGS. 3 and 5, and the light of the LED 32 is illuminated on the portion of the latent image on the photoconductor drum 15 which corresponds to the area A of the transfer sheet P in order to erase the latent image (step ST10).

Figure 11:
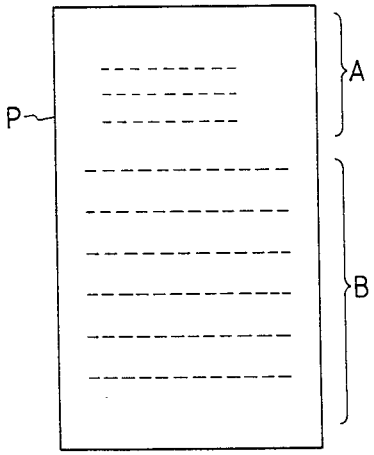
FIG. 11 shows an image transferred to the transfer sheet.

Then, the latent image formed on the photoconductor drum 15 is developed (step ST11 ), and the developed image is transferred to the transfer sheet P (step ST12) so that the image is transferred to the area B in the transfer sheet as shown in FIG. 11 (step ST13).

The latent image erase means may erase the latent image on the photoconductor drum corresponding to the area A by turning on and off the developing bias.

Where a positive transfer image is to be formed from a negative image of the film, the liquid crystal shutter 31 is activated on the exposure light focusing line 15a to shut the light to the area of the photoconductor drum 15 corresponding to the area of $X_1$ and $Y_1$ in FIG. 10. Thus the illumination of the light to the charged area on the photoconductor drum 15 corresponding to the area A of the transfer sheet P is prevented to inhibit the formation of the latent image in the area A.

Figure 12:
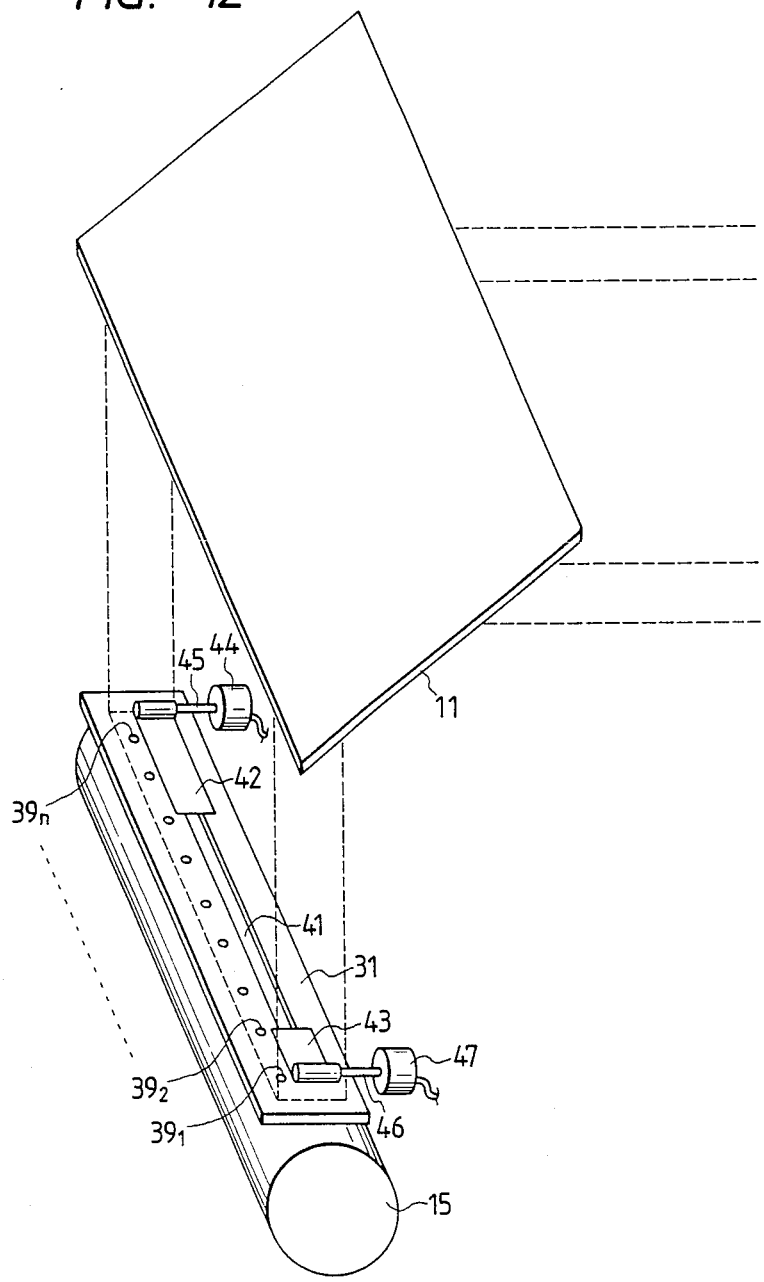
FIG. 12 is a perspective view of image copying area control means.

In another embodiment of the invention, as shown in FIG. 12, a slit 41 is formed along the axis of the photoconductor drum 15, and a pair of opaque film shutter plates 42 and 43 for changing an aperture length of the slit to control the exposure area along the axis of the photoconductor drum 15 are provided. The shutter plates 42 and 43 are rewindably wound around drive shafts 45 and 46 of pulse motors 44 and 47, and the pulse motors 44 and 47 are controlled by the microcomputer 34 to change the aperture length of the slit 41 at the opposite ends thereof.

In accordance with the present invention, where the transfer sheet has print or other image or characters on a portion thereof, the image is formed on the nonimage area excluding the recorded area. If the image to be formed overlaps with the recorded area, an alarm alerts the operator. Accordingly, the apparatus prevents overlapped record of image and a notice may be issued to the operator to reduce the film image to be copied, by a lens.

In order to change a projection magnification of the image, a zoom lens may be used as the projection lens 5, or a plurality of lenses having different magnifications may be arranged on a turret and the turret may be turned to put a selected projection lens into the light path.

Figure 13:
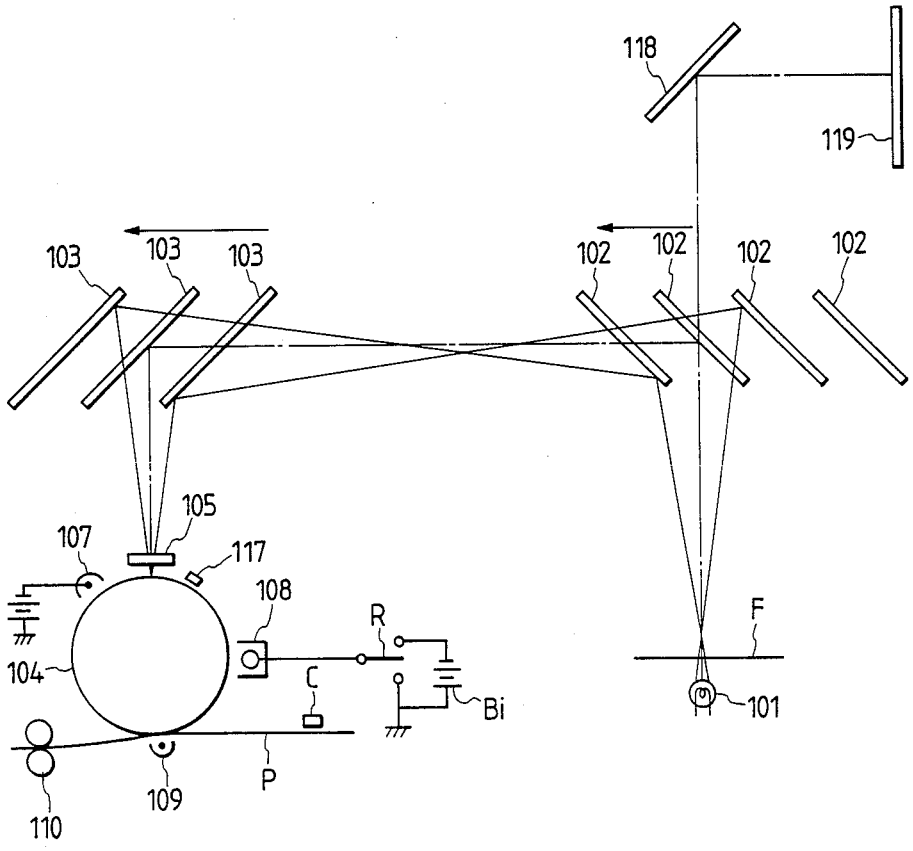
FIG. 13 shows a configuration of another embodiment of the image recording apparatus of the present invention.

FIG. 13 shows a reader/printer as another embodiment of the image recording apparatus of the present invention. In FIG. 13, F denotes a rolled microfilm as an original document, numeral 101 denotes a projection lamp, numerals 102 and 103 denote scan mirrors arranged at an angle of 90 degrees to each other, numeral 104 denotes a photoconductor drum as an image recording medium, numeral 105 denotes a shutter base arranged above the photoconductor drum 104 and having a slit (not shown) along an axis thereof, numeral 107 denotes a primary charger, numeral 108 denotes a developing unit, numeral 109 denotes a transfer charger, numeral 110 denotes a fixing unit, and numeral 119 denotes a screen on which an image of the micro-film F is projected with enlargement through the mirror 118. Bi denotes a power supply for supplying a development potential to the developing unit 108, R denotes a relay for controlling a current from the power supply B, and numeral 117 denotes an LED array having n LED's arranged thereon.

In the above arrangement, the light emitted from the projection lamp 101 passes through the microfilm F. The light image of the micro-film is reflected by the scan mirrors 102 and 103 and passes through the slit (not shown) formed in the shutter base. The light which has passed through the slit scans the surface of the photoconductor drum 104 which has been uniformly charged by the corona discharge of the primary charger 107 so that the light exposure area is discharged and an electrostatic latent image is formed. The electrostatic latent image is developed by the developing unit 108 to which the developing potential is applied by the power supply Bi. An electric field is applied to the developed toner on the photoconductor drum by the transfer charger 109 to transfer the toner image to the transfer sheet. The transferred image is fixed by heat and pressure by the fixing unit 110. The image of the micro-film F by the light emitted from the projection lamp 101 is projected to the screen 119 with enlargement through the mirror 118.

Figure 14:
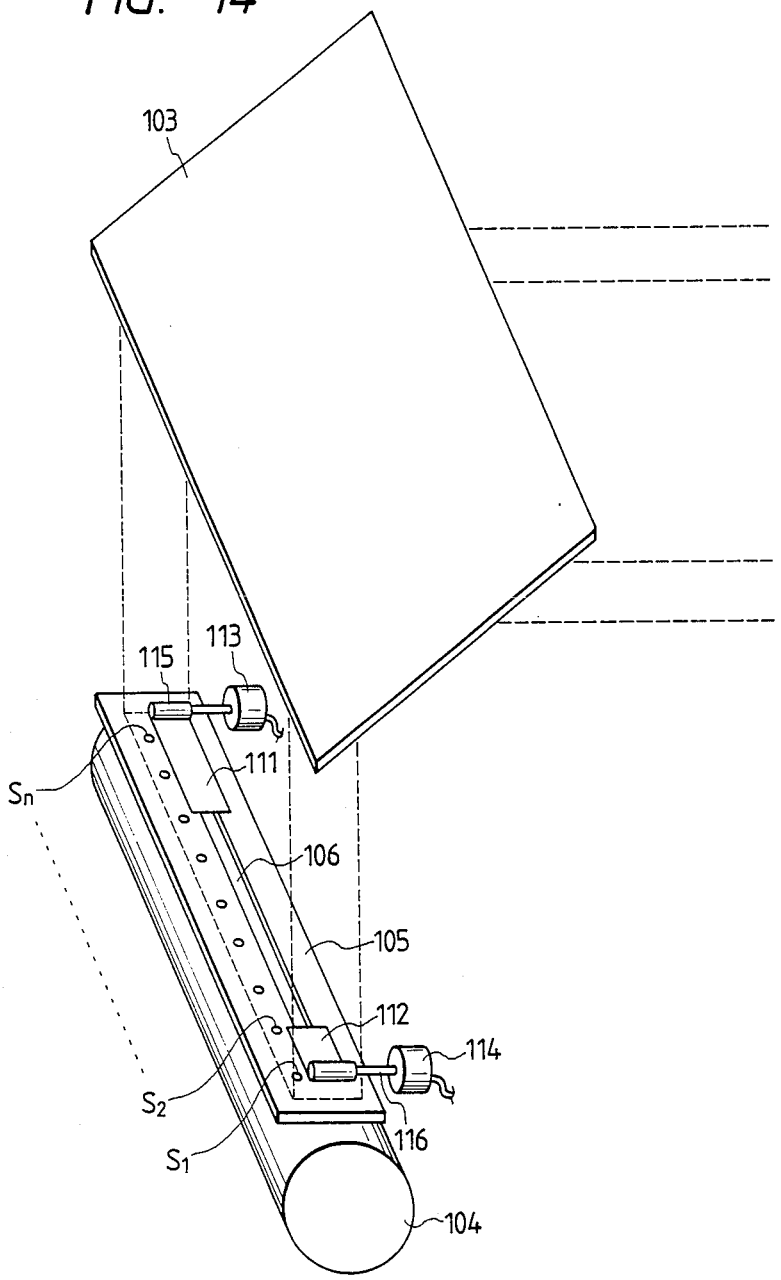
FIG. 14 shows a perspective view of major portions of FIG. 13.

FIG. 14 shows a construction of means for defining the image copy area of the micro-film.

As shown in FIG. 14, the slit 106 is formed axially on the photoconductor drum 104 in the shutter base 105, and a pair of shutter plates 111 and 112 for controlling the exposure area along the axis of the photoconductor drum 104 by changing the aperture length of the slit 106 are provided with the shutter base 105. The shutter plates 111 and 112 are opaque films and rewindably wound around drive shafts 115 and 116 of pulse motors 113 and 114. As the pulse motors 113 and 114 are rotated, the shutter plates 111 and 112 are rewound to change the aperture length at the opposite ends. Photosensors $S_1$–$S_n$ made of amorphous silicon are arranged at a predetermined pitch on the shutter base 105.

In the arrangement shown in FIG. 14, the light image of the microfilm reflected by the mirror 103 is projected to the shutter base 105 having the slit 106 and the photosensors $S_1$–$S_n$. As shown in FIG. 13, the printed information on the transfer sheet P fed from the sheet port is detected by a contact sensor C. The pulse motors 113 and 114 move the shutter plates 111 and 112 through the drive shafts 115 and 116 to change the aperture length of the slit 106.

In the image recording apparatus of the present embodiment, the image information is recorded in the following manner. Prior to the exposure of image to the photoconductor drum 104, the scan mirrors 102 and 103 are prescanned to expose the image of the micro-film F to the photo-sensors $S_1$–$S_n$ on the shutter base 105. The image intensity data detected by the photo-sensors $S_1$–$S_n$ during the prescan is digitized by an A/D converter (not shown) and read into a CPU to be described later. The CPU binaries the data based on predetermined threshold (slice level) and stores it in a RAM to be described later. Thus, the image intensity distribution is divided by a predetermined time interval in a scan direction of the scan mirrors 102 and 103, and by a pitch of the photo-sensors $S_1$–$S_n$ in a direction orthogonal to the scan direction. For a negative image, data having a higher intensity than the slice level is coded as "0", and data having a lower intensity is coded as "1", and they are sequentially stored into the RAM. When the microfilm F has a positive image, the higher intensity data is coded as "1" and the lower intensity data is coded as "0". In this manner, the image area for the image of the micro-film F is automatically detected.

Figure 15:
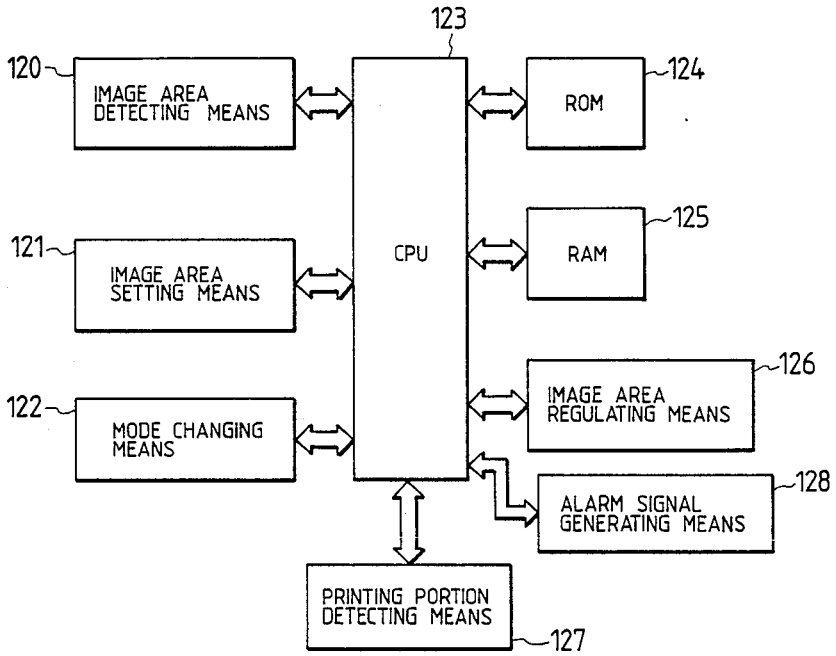
FIG. 15 shows a block diagram of a circuit configuration of the embodiment.

FIG. 15 shows a block diagram of a control unit of the present embodiment. In FIG. 15, numeral 120 denotes image area detecting means shown by the photosensors $S_1$–$S_n$, numeral 121 denotes the image area setting means for setting the to-be-copied image area, numeral 122 denotes mode changing means, numeral 123 denotes a CPU as the control means, numeral 124 denotes a read-only memory (ROM) which stores a predetermined process program of the CPU 123, numeral 125 denotes a random access memory (RAM), numeral 126 denotes image area regulating means for controlling the aperture length of the slit 106, the on/off timing of the relay R and the light emission of the LED array 117, numeral 127 denotes transfer sheet printing portion detecting means having a contact image sensor C for detecting the printed area of the transfer sheet P during the feed of the transfer sheet P, and numeral 128 denotes alarm signal generating means for generating an alarm signal by the CPU 123 to alert to the operator when the micro-film image area and the transfer sheet printed area overlap. The mode changing means 122 will be described later.

In the present embodiment, the image intensity data detected by the photo-sensors $S_1$–$S_n$ is read by the CPU 123, which binaries the data and stores it in the RAM 125. The area information (size and position of the printed area) of the printed area detected by the transfer sheet printing portion detecting means 127 is compared with the image area of the micro-film, and if it is not proper for the image area, that is, if both areas do not overlap, the image of the micro-film is recorded. If the printed area and the image area overlap, the image area regulating means 126 inhibits the recording of the image on the transfer sheet, and the alarm signal generating means 128 generates the alarm signal to inform the operator of the improper status.

Figure 16A:
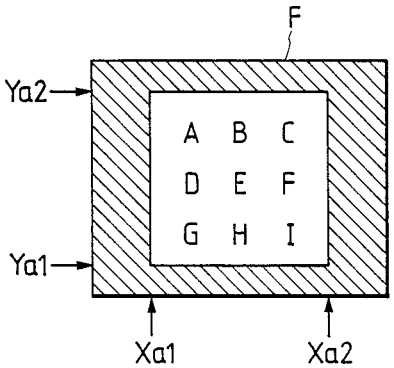
FIG. 16A shows an image of a micro-film.
Figure 16B:
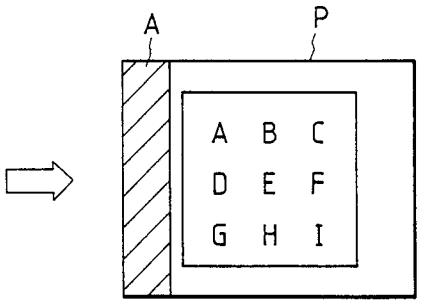
FIG. 16B shows an image copied by image area selection means of the embodiment.
Figure 17:
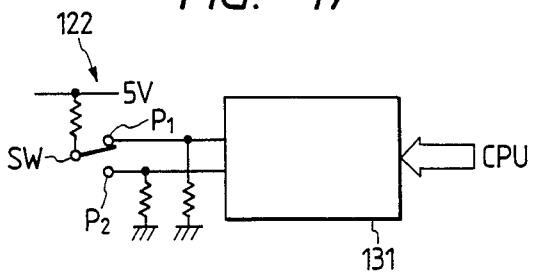
FIG. 17 shows a circuit diagram of mode select means.
Figure 18:
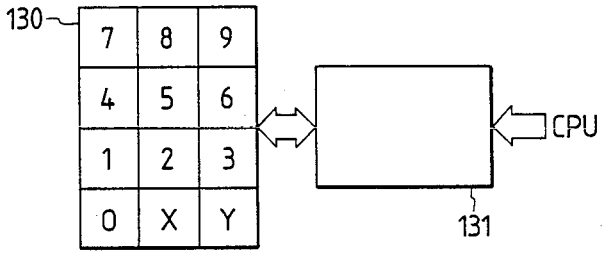
FIG. 18 shows a block diagram of image area setting means of FIG. 15.

The automatic image area detection has thus been described. The copied image does not include solid black area, as shown in FIG. 16(B). The area A is the printed area In the present embodiment, manual image area designation may be performed prior to the start of the image record operation. In the mode select means 122 of FIG. 17, terminals $P_1$ and $P_2$ of a switch SW are switched to send out a switching signal to the CPU 123 through an I/O port 131 to change the mode from the automatic image area selection to the manual record area designation. The manual record area designation is carried out by the key pad 130 as shown in FIG. 18. The signal from the key pad 130 is stored as position information in the RAM 125 through the I/O port 131 and the CPU 123. In order to manually designate the image area, keys "X" and "1" on the key pad 130 are sequentially depressed and a position of "Xml" is set in millimeters. Then, keys "X" and "2" are depressed and a position of "Xm2" is set. On the other hand, when a Y axis is to be designated, keys "Y" and "1" are depressed, and a position of "Yml" is set in millimeters. Then, keys "Y" and "2" are depressed in a position of "Ym2" is set (FIGS. 19(A) and 19(B)). origin point for position setting may be a left bottom corner of the screen. When the switch SW is in contact to the terminal $P_1$, the image area regulating means 126 is controlled in accordance with the position information of the manual record area designation. When the switch SW is in contact to the terminal $P_2$, the image area regulating means 126 is controlled in accordance with the position information of the automatic image area detection means. When the image area overlaps with the area detected by the transfer sheet printing portion detecting means 127, the image area regulating means 126 inhibits the recording of image on the transfer sheet, and the alarm is issued to the operator. When the image area on the micro-film does not overlap with the printed area of the transfer sheet, the image recorded under the control of the image area regulating means 126.

Figure 20:
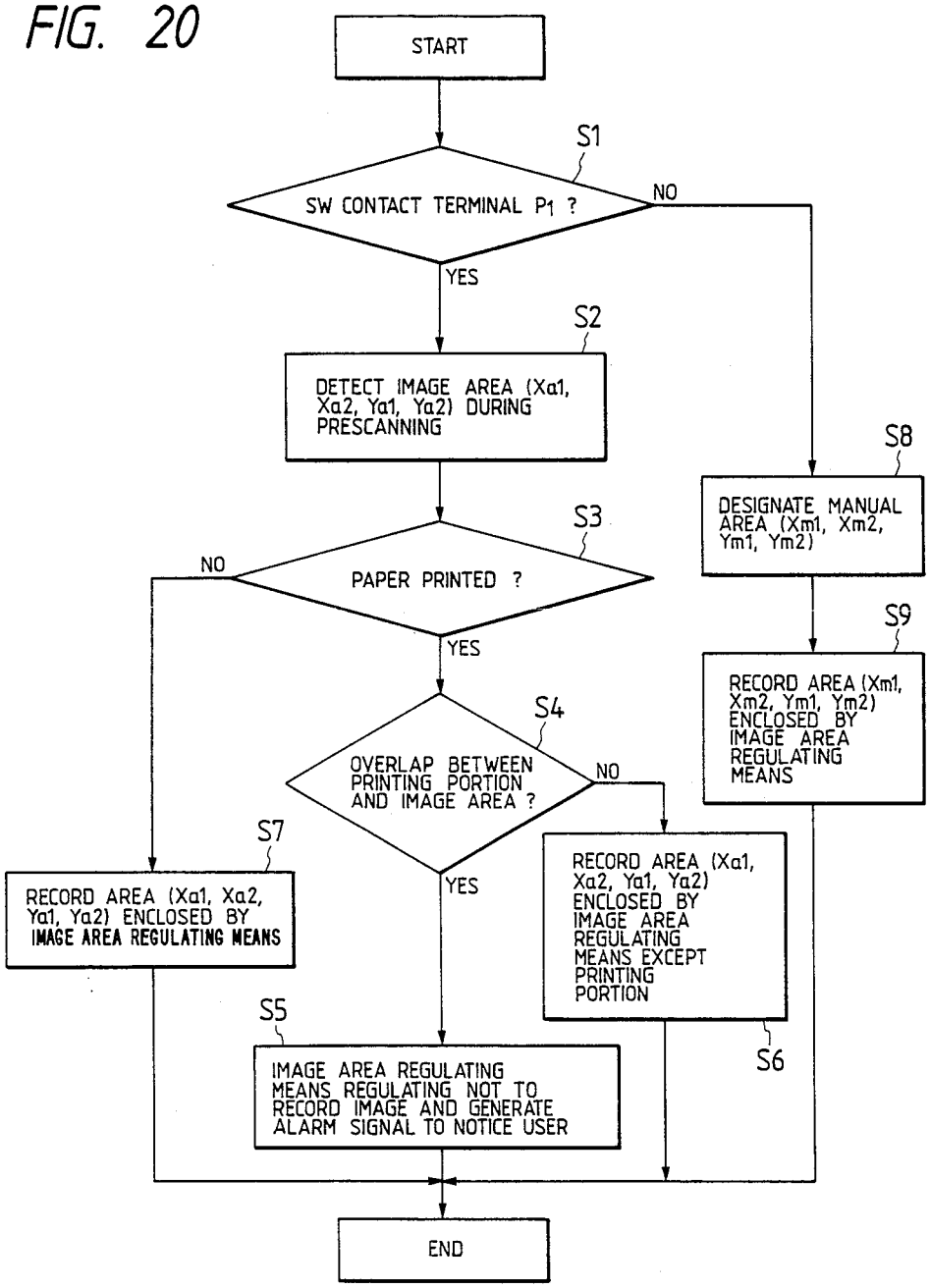
FIG. 20 shows a flow chart of a control unit of the embodiment.

The control unit is explained with reference to the flow chart shown in FIG. 20. In a step S1, whether the switch SW is in contact to the terminal $P_1$ or not is checked. If it is , the image area (Xa1,Xa2, Ya1,Ya2) shown in FIG. 16(A) is detected during the prescan, in a step S2. In a step S3, whether the transfer sheet P has a printed area or not is checked. If it has, whether the printed area of the transfer sheet overlaps with the image area of the microfilm or not is checked, in a step S4. If it overlaps, the image area regulation means 126 inhibits the recording of image to the transfer sheet and issues an alarm to the operator, in a step S5. If the images do not overlap in the step S4, the image is recorded in the area surrounded by Xa1, Xa2, Ya1 and Ya2 excluding the printed area by the image regulating means 126, in a step S6. In the step S3, if the transfer sheet has no printed area, the image is recorded in the area surrounded by Xa1, Xa2, Ya1 and Ya2 by the image area regulation means 126, in a step S7 (FIG. 16(B)).

Figure 19A:
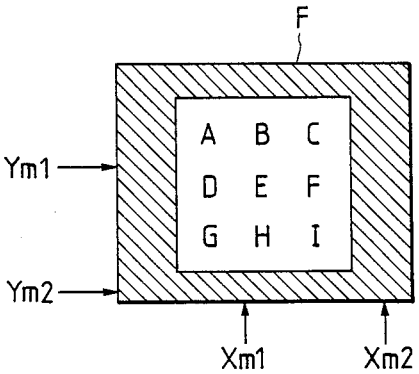
FIG. 19A shows an image of an micro-film.
Figure 19B:
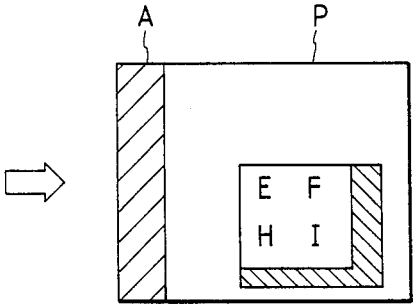
FIG. 19B shows an image copied by manual recorded area specify means in the embodiment.

On the other hand, if the switch SW is in contact to the terminal $P_2$ instead of the terminal $P_1$ in the step S1, the manual area designation (Xm1, Xm2,Ym1,Ym2) shown in FIG. 19(A) is conducted in a step S8. In a step S9, the image is recorded in the area surrounded by Xm1, Xm2, Ym1 and Ym2 by the image area regulating 126.

Based on the above position information, the CPU 123 controls the toner development in the scan direction of the micro-film, that is, in the direction of rotation of the photo-conductor drum 104 by turning on or off the contact of the relay R shown in FIG. 13 to turn on or off the developing bias. For the direction orthogonal to the scan direction of the micro-film, that is, in the axial direction of the photoconductor drum, the pulse motors 113 and 114 shown in FIG. 14 are driven to wind or rewind the shutter plates 111 and 112 to control the aperture length of the slit 106. Under this condition, the scan mirrors 102 and 103 are scanned and the relay R is turned on or off to record the image on the transfer sheet P.

Figure 21:
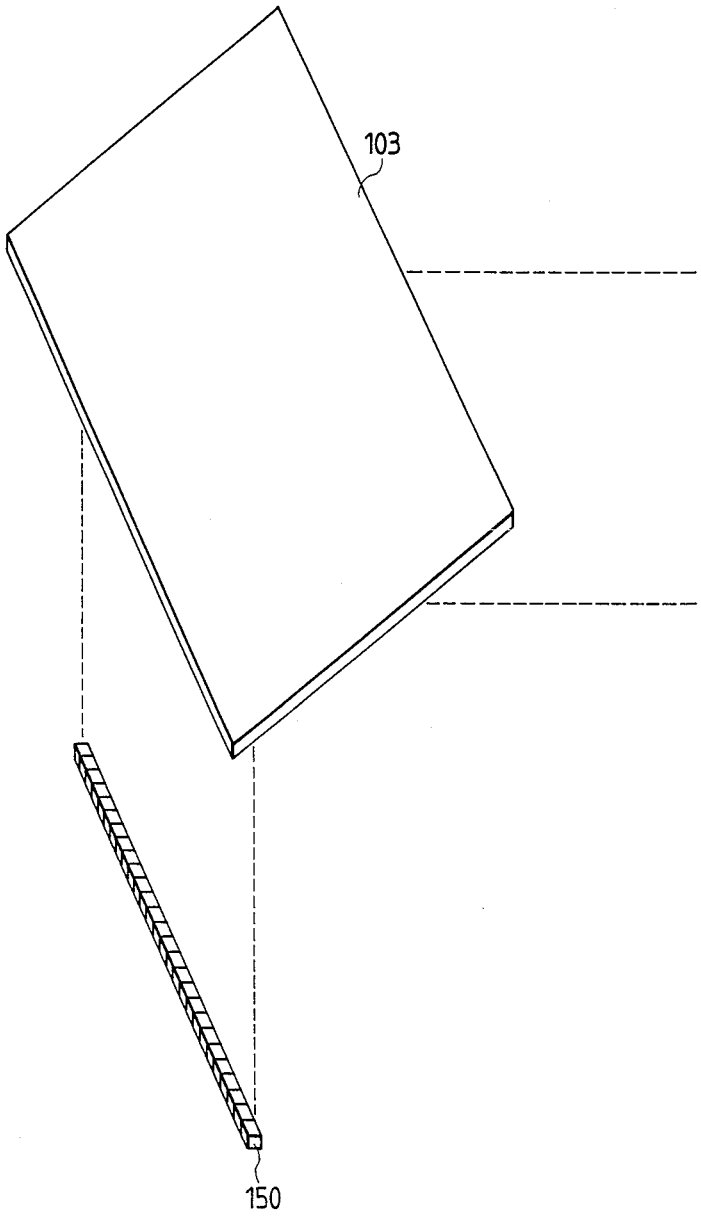
FIGS. 21, 22 and 23 show perspective view and block diagram of other embodiment of the present invention.
Figure 22:
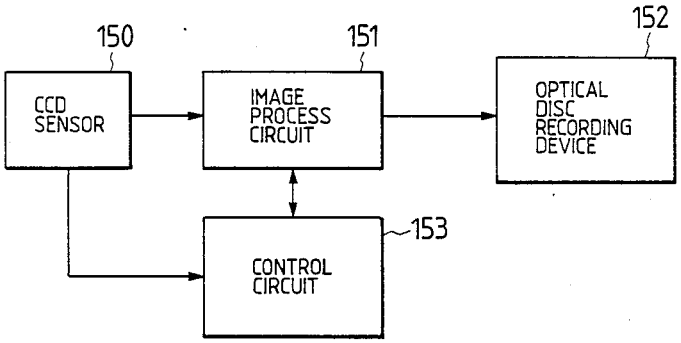

FIGS. 21 and 22 shown other embodiment of the present invention. The like elements to those of the previous embodiment are designated by the like numerals. In the present embodiment, the image of the micro-film is read by a CCD sensor 150, and the image is recorded on an optical disk recording device 152 through an image process circuit 151. Numeral 153 denotes a control circuit. Other construction and function are same as those of the previous embodiment, and the explanation thereof is omitted.

In the illustrated embodiments, the circumferential image record area of the photoconductor drum 104 is recorded by turning on and off the developing bias, although the present invention is not limited thereto, alternatively, the entire slit may be opened or closed by a shutter, the primary charge may be turned on or off, or the developing unit may be contacted to or separated from the photoconductor drum.

While the transfer sheet is used as the recording medium in the embodiments, the recording medium may be optical disk, optomagnetic disk, magnetic disk or magnetic tape.

In order to detect the printed area on the transfer sheet, photo-sensors other than the CCD may be used. When the image area of the micro-film overlaps with the printed area of the transfer sheet, the recording of the image on the transfer sheet is inhibited and the alarm is issued to the operator. Alternatively, the printed area of the transfer sheet may be detected by a contact sensor, and if the printed area overlaps with the image area of the microfilm (automatic transfer, manual transfer), the paper feed means is stopped in the reverse position and the alarm is issued by a lamp to inform the operator of the error. When a number of copies have been requested, one blank transfer sheet may be ejected and the copy operation may be stopped to inform the operator of the error.

As described above, in the prior art apparatus, when the film image is recorded on the preprinted formatted sheet by the automatic area designation or manual area designation, if the image area of the film overlaps with the printed area of the transfer sheet, the resultant copy is not acceptable because the film image overlaps with the printed area of the transfer sheet. Otherwise, the film image area is hidden by the printed area of the transfer sheet and the operator does not notice it. In the present embodiment, the alarm is issued to the operator and the blank transfer sheet is ejected so that it may be used again.

Figure 23:
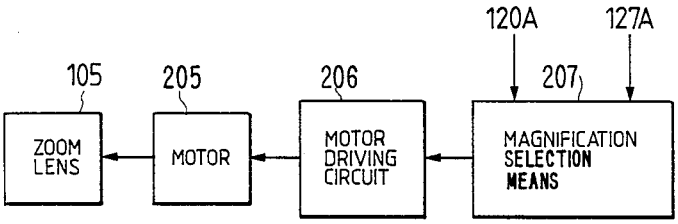

FIG. 23 shows a block diagram of an embodiment of magnification varying means. The image of the film F is projected by a zoom lens 105 onto a screen 119 and a photoconductor drum 104. Numeral 205 denotes a motor for driving the zoom lens 105 to change the magnification of projection, numeral 206 denotes a motor driving circuit, and numeral 207 denotes magnification selection means which receives a first signal 120A representing the image area produced by the image area detecting means 120 and a second signal 127A representing the printed area produced by the transfer sheet printing portion detecting means 127 to determine a projection magnification which allows the image of the image area detected by the image area detecting means 120 to be recorded in the unprinted area of the transfer sheet. Based on the magnification data determined by the magnification selection means 207, the motor 205 is driven and the zoom lens 105 is set to the selected magnification. Thus, the image is recorded on the transfer sheet without overlap with the printed area of the transfer sheet.

I claim:

1. An image recording apparatus for recording an image on a recording medium, comprising:

detection means for detecting an information recorded area on the recording medium;

setting means for setting a to-be-recorded area for the recording medium;

determination means for determining if the information recorded area detected by said detection means and the image area set by said setting means overlap; and signal generating means for generating a signal when said determination means determines the overlap.

2. An image recording apparatus according to claim 1 wherein said detection means includes a photosensor for optically scanning the recording medium.

3. An image recording apparatus according to claim 2 wherein said photo-sensor is arranged along a movement path of the recording medium and scans the recording medium as the recording medium is moved.

4. An image recording apparatus according to claim 1 wherein said setting means includes switching means for indicating the to-be-recorded area of the image for the recording medium.

5. An image recording apparatus according to claim 1 further comprising means for issuing an alarm in response to the signal generated by said signal generating means.

6. An image recording apparatus according to claim 1 further comprising:

record means for recording an image on the recording medium; and stop means for stopping the operation of said record means in response to the signal generated by said signal generating means.

7. An image recording apparatus according to claim 6 further comprising control means for controlling said record means to record the image of the area set by said setting means to the recording medium.

8. An image recording apparatus according to claim 7 wherein said record means includes means for forming an electrostatic charged image corresponding to the image on an image carrier, developing means for developing the electrostatic charged image formed on the image carrier, and transfer means for transferring the developed image to the recording medium.

9. An image recording apparatus according to claim 8 wherein said control means includes means for inhibiting the image from being recorded on the portion of the recording medium corresponding to the area other than the area set by said setting means.

10. An image recording apparatus according to claim 1 further comprising means for selecting an automatic mode for automatically setting the to-be-recorded area and a manual mode for manually setting the to-be-recorded area.

11. An image recording apparatus according to claim 10 wherein said setting means includes an image detection means for detecting an image area of an original document and means for specifying a to-be-recorded area of the original document in accordance with the output of said image detection means.

12. An image recording apparatus comprising:

first signal output means for producing a first signal indicating a recorded area of a recording medium;

second signal output means for producing a second signal indicating a to-be-recorded area of an original document;

record means for recording the to-be-recorded area of the original document to the recording medium;

determination means for determining, based on said first signal and said second signal, whether the recorded area of the recording medium and the to-be-recorded area of the original document overlap; and record control means for controlling the operation of said record means in accordance with the determination by said determination means.

13. An image recording apparatus according to claim 12 wherein said first signal output means includes detection means for detecting the recorded area or unrecorded area of the recording medium.

14. An image recording apparatus according to claim 13 wherein said detection means includes a photosensor, and said photo-sensor is moved relatively to the recording medium.

15. An image recording apparatus according to claim 12 wherein said second signal output means includes switching means for indicating the to-be-recorded area of the original document.

16. An image recording apparatus according to claim 12 wherein said second signal output means includes detection means for detecting the image area of the original document.

17. An image recording apparatus according to claim 16 wherein said detection means includes a photosensor, and said sensor is moved relatively to the original document.

18. An image recording apparatus according to claim 12 wherein said record means includes a photoconductor, means for moving the photoconductor, means for forming uniform electrostatic charge on the photoconductor, means for exposing the image of the original document to the photoconductor, means for developing the electrostatic image formed on the photoconductor, and means for transferring the developed image to the recording medium.

19. An image recording apparatus according to claim 12 wherein said record control means stops the record operation of said record means when said determination means determines the overlap.

20. An image recording apparatus according to claim 12 wherein said record means includes means for varying a recording magnification of the image, and the magnification of said varying means is controlled by the output of said determination means.

21. An image recording apparatus according to claim 12 further comprising display means for displaying the image of the original document on a display screen.

22. An image recording apparatus according to claim 12 wherein said record means includes an image sensor for reading the image of the original document and means for recording the signal produced by the image sensor to the recording medium.

* * * * *

UNITED STATES PATENT AND TRADEMARK OFFICE

CERTIFICATE OF CORRECTION

PATENT NO. : 4,876,570

DATED : October 24, 1989

INVENTOR(S) : TOSHIO IWAYA

It is certified that error appears in the above-identified patent and that said Letters Patent is hereby corrected as shown below:

COLUMN 1

Line 19, "to recognized" should read --to recognize.--.
Line 24, "micro-film" should read --micro-film,--.

COLUMN 2

Line 41, "an micro-film," should read --a micro-film,--.
Line 47, "other" should read --another--.
Line 67, "drum 15" should read --drum 15,--.

COLUMN 3

Line 17, "to facing" should read --facing a--.
Line 35, "transfer charge 20." should read --transfer charger 20.--.

COLUMN 4

Line 14, "binaries" should read --binarizes--.
Line 30, "contents" should read --stored contents--.
Line 45, "changer 20" should read --charger 20--.

COLUMN 5

Line 32, "prevents" should read --prevents the--.

COLUMN 6

Line 46, "binaries" should read --binarizes--.

UNITED STATES PATENT AND TRADEMARK OFFICE

CERTIFICATE OF CORRECTION

PATENT NO. : 4,876,570

DATED : October 24, 1989

INVENTOR(S) : TOSHIO IWAYA

It is certified that error appears in the above-identified patent and that said Letters Patent is hereby corrected as shown below:

COLUMN 7

Line 16, "binaries" should read --binarizes--.
Line 51, "in" should read --and--.
Line 52, "origin" should read --An origin--.
Line 67, "recorded" should read --is recorded--.

COLUMN 8

Line 10, "regulation means" should read --regulating means--.
Line 19, "regulation means 126" should read --regulating means 126--.
Line 25, "126." should read --means 126.--.
Line 41, "shown other" should read --show another--.
Line 53, "bias," should read --bias.--.
Line 54, "although" should read --Although--.

Signed and Sealed this

Seventh Day of August, 1990

*Attest:*

*Attesting Officer*

HARRY F. MANBECK, JR.

*Commissioner of Patents and Trademarks*